US007071958B2

(12) United States Patent
Liaw et al.

(10) Patent No.: US 7,071,958 B2
(45) Date of Patent: Jul. 4, 2006

(54) COLOR ELECTRODE ARRAY PRINTER

(75) Inventors: Yung-Shane Liaw, Taipei Hsien (TW); Jen-Chun Hsu, Taipei (TW)

(73) Assignee: BenQ Corporation, Tao-Yuan Hsien (TW)

( * ) Notice: Subject to any disclaimer, the term of this patent is extended or adjusted under 35 U.S.C. 154(b) by 261 days.

(21) Appl. No.: 10/709,504

(22) Filed: May 11, 2004

(65) Prior Publication Data

US 2004/0227802 A1 Nov. 18, 2004

(30) Foreign Application Priority Data

May 15, 2003 (TW) ..... 92113217 A

(51) Int. Cl.

| | |
|---|---|
| ***B41J 2/005*** | (2006.01) |
| ***B41J 2/41*** | (2006.01) |
| ***G03G 15/05*** | (2006.01) |
| ***G03G 15/01*** | (2006.01) |

(52) U.S. Cl. ..... 347/120; 347/141; 347/123

(58) Field of Classification Search ..... 347/120, 347/123, 141

See application file for complete search history.

(56) References Cited

U.S. PATENT DOCUMENTS 6,760,051 B1 * 7/2004 Fujii et al. ..... 347/141
6,899,854 B1 * 5/2005 Darty ..... 422/186.04

FOREIGN PATENT DOCUMENTS

JP 2-185451 * 7/1990

* cited by examiner

*Primary Examiner*—Huan Tran
(74) *Attorney, Agent, or Firm*—Winston Hsu

(57) ABSTRACT

An electrode array printer has a housing, an image roller, and a plurality of developer modules. Each of the developer modules has an electrode array printhead, a toner cartridge and a developer roller. The electrode array printhead is installed on a side surface of the image roller for emitting an electron array onto the side surface of the image roller to form an electrostatic image. The developer roller is capable of attracting toner contained in a corresponding toner cartridge. The electrostatic image formed on the side surface of the image roller is capable of attracting toner from a developer roller corresponding to the electrode array printhead when the image roller rotates to a position where the electrostatic image is adjacent to the developer roller. The printer further includes a transfer roller, a fuser and a toner blade.

17 Claims, 11 Drawing Sheets

COLOR ELECTRODE ARRAY PRINTER

BACKGROUND OF INVENTION

1. Field of the Invention

The present invention relates to a printer, and more particularly, to a printer comprising a plurality of electrode arrays for forming an electrostatic image onto an image roller of the color printer, the electrostatic image capable of attracting toner contained in a toner cartridge of the color printer and forming a printed image.

2. Description of the Prior Art

Please refer to FIG. 1, which is a schematic diagram of a laser printer 10 according to the prior art. The laser printer 10 comprises a housing 71 (not shown), an image roller 12 rotatably installed inside the housing 71, a charged roller 14 for disposing positive charges onto the image roller 12, a laser beam unit 16 for emitting laser beams onto the image roller 12, a toner cartridge 18 containing toner, a developer roller 20 installed on a side of the toner cartridge 18 capable of attracting toner contained in the toner cartridge 18, a transfer roller 22 electrically connected to a negative bias voltage (not shown), a fuser 24 for melting plastic components of the toner contained in the toner cartridge 18, and a discharge unit 26 for cleaning charge residues on the image roller 12.

Principles and operations of the laser printer 10 are briefly described as follows: The charged roller 14 disposes positive (or negative) charges onto the image roller 12. The laser beam unit 16 emits laser beams of a variety of levels onto a predetermined region of the image roller 12. Since the image roller 12 is made of photoconductive material, when the predetermined region of the image roller 12 receives the laser beams emitted by the laser beam unit 16, the charges initially disposed on the predetermined region are affected by photons of the laser beams and trigger the photoconductive material to conduct and discharge, forming an electrostatic image of a relative low level on the predetermined region. A voltage at a point of the electrostatic image relates to power of a laser beam received by the point. That is, the higher the power of the laser beam, the larger a voltage difference of the point becomes; on the contrary, the lower the power of the laser beam, the smaller the voltage difference of the point becomes. After a while, when the image roller 12 rotates to a position where the electrostatic image is adjacent to the developer roller 20, since the develop roller 20 has attracted toner contained in the toner cartridge 18, the electrostatic image of an appropriate level is capable of attracting the toner on the developer roller 20. The larger the voltage difference of the electrostatic image is, the more toner the electrostatic image can attract, and vice versa. When the image roller 12 proceeds to rotate to another position where the electrostatic image is adjacent to the transfer roller 22, since the transfer roller 22 is connected with a negative bias voltage, which is lower than voltages at all points of the electrostatic image (the absolute value of the negative bias voltage is higher than the absolute values of voltages at all points of the electrostatic image), the transfer roller 22 is capable of attracting all the toner on the electrostatic image to a printing media 11 disposed between the transfer roller 22 and the image roller 12. The toner is now temporarily disposed on the printing media 11 due to electrostatic force of the toner only, so any impact (external force, etc) to the laser printer 10 can disturb the toner. After the printing media 11 passing through the fuser 24, the heat that the fuser 24 generates melts the plastic material of the toner and adheres the melted toner onto the printing media 11. When the transfer roller 22 has transferred toner on the electrostatic image onto the printing media 11 and the image roller 12 rotates to a position where the electrostatic image is adjacent to the discharging unit 26, the discharging unit 26 discharges charges of the electrostatic image completely such that the image roller 12 can regain charges disposed by the charged roller 14 when rotating to a position adjacent to the charged roller 14.

The laser beam unit 16 of the laser printer 10 comprises a laser unit 17 for emitting laser beams by determining page data, and a movable mirror 19 for reflecting the laser beams emitted by the laser unit 17 onto the predetermined region of the image roller 12. The laser beam unit 16 requires a high-quality laser unit 17 for emitting beams onto the predetermined region precisely.

The laser printer 10 shown in FIG. 1 is a black-and-white laser printer. Please refer to FIG. 2, which is a schematic diagram of a Carousel color laser printer 30 according to the prior art. The color laser printer 30 comprises an image roller 32, a charged roller 34, a laser beam unit 36, a transfer roller 42, a fuser 44, and a discharging unit 46. A printing media is disposed between the image roller 32 and the transfer roller 42. Different from the laser printer 10, the color laser printer 30 comprises four sets of toner cartridges 38Y, 38C, 38M and 38K containing yellow, cyan, magenta and black toner, and four corresponding developer roller 40Y, 40C, 40M and 40K.

The color laser printer 30 has principles and operations similar to those of the black-and-white laser printer 10. The only difference is that the color laser printer 30 has to execute four times the operations of: charge disposition, emitting laser beams onto the image roller 32 and forming an electrostatic image, attracting toner contained in each of the toner cartridges 38Y, 38C, 38M and 38K with the electrostatic image, transferring the image, and discharging charges and feeding the printing media 31 through the fuser 44 to melt and adhere the toner. Such quantity of operations executed by the color laser printer 30 is time-consuming.

Please refer to FIG. 3, which is a schematic diagram of a Tandem color laser printer 50 according to the prior art. The color laser printer 50 comprises a fuser 64, four toner cartridges 58Y, 58C, 58M and 58K for containing yellow, cyan, magenta and black toner respectively, and four corresponding developer rollers 60Y, 60C, 60M and 60K. In contrast to the Carousel color laser printer 30, the Tandem color laser printer 50 comprises four image rollers 52Y, 52C, 52M and 52K, four charged rollers 54Y, 54C, 54M and 54K, four laser beam units 56Y, 56C, 56M and 56K, and four transfer rollers 62Y, 62C, 62M and 62K. Four printing medias are disposed between the transfer rollers 62Y, 62C, 62M and 62K and corresponding image rollers 52Y, 52C, 52M and 52K respectively.

The color laser printer 50 also has principles and operations similar to those of the laser printer 10. The only difference is that the color laser printer 50 executes four times the operations of charge disposition, emitting laser beams onto the corresponding image rollers to form electrostatic images, attracting toner contained in corresponding toner cartridges with the electrostatic image, transferring images and discharging charges simultaneously to attract toner contained in the toner cartridges onto the printing media 51Y, 51C, 51M and 51K respectively. Since the Tandem color laser printer 50 is capable of printing the four printing media 51Y, 51C, 51M and 51K simultaneously, printing four colors of toner onto a printing media equivalently, the Tandem color laser printer 50 runs four times as fast as the Carousel color laser printer 30. However, the color laser printer 50 comprises four toner cartridges, four developer rollers, four image rollers, four charged rollers, four laser beam units, four transfer rollers, and four discharging units to perform with such a high efficiency, and thus, has disadvantages of high-cost and bulk. In addition, the color laser printer 50 cannot dispose toner onto the printing media 51Y, 51C, 51M and 51K precisely unless the laser beam units 56Y, 56C, 56M and 56K all have high quality and function in perfect coordination with the transfer rollers 62Y, 62C, 62M and 62K.

SUMMARY OF INVENTION

It is therefore a primary objective of the claimed invention to provide an efficient and low-cost electrode array printer to overcome the disadvantages of the prior art.

According to the claimed invention, the electrode array printer comprises a housing, an image roller rotatably installed inside the housing, a plurality of developer modules installed surrounding the image roller, and a transfer roller rotatably installed adjacent to the side surface of the image roller and electrically connected to a first bias voltage, the first bias voltage enabling a printing media disposed between the image roller and the transfer roller to attract toner attracted by the electrostatic image. Each of the developer modules comprises an electrode array printhead installed adjacent to a side surface of the image roller for emitting an electron array of a predetermined level onto the side surface and forming a electrostatic image on the side surface, a toner cartridge installed inside the housing for containing toner, and a developer roller rotatably installed adjacent to the toner cartridge, the developer roller capable of attracting the toner contained in the toner cartridge, and the electrostatic image capable of attracting toner attracted by the developer roller when the developer roller rolls to a position where the developer roller is adjacent to the electrostatic image.

The image roller comprises a conductive bias potential layer electrically connected to a second bias voltage, and a dielectric layer formed on the conductive bias potential layer, the second bias voltage enabling the electrostatic image formed on the image roller to attract toner in the toner cartridge.

It is an advantage of the claimed invention that a electrode array printer comprising an electrode array printhead to substitute for the charged roller and laser beam unit of the prior art color printer reduces bulk and cost to design. In addition, in contrast to the operations of charge disposition and emitting laser beams to form an electrostatic image performed by the prior art, the electrode array printhead can execute the operation of charge disposition with better print quality.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
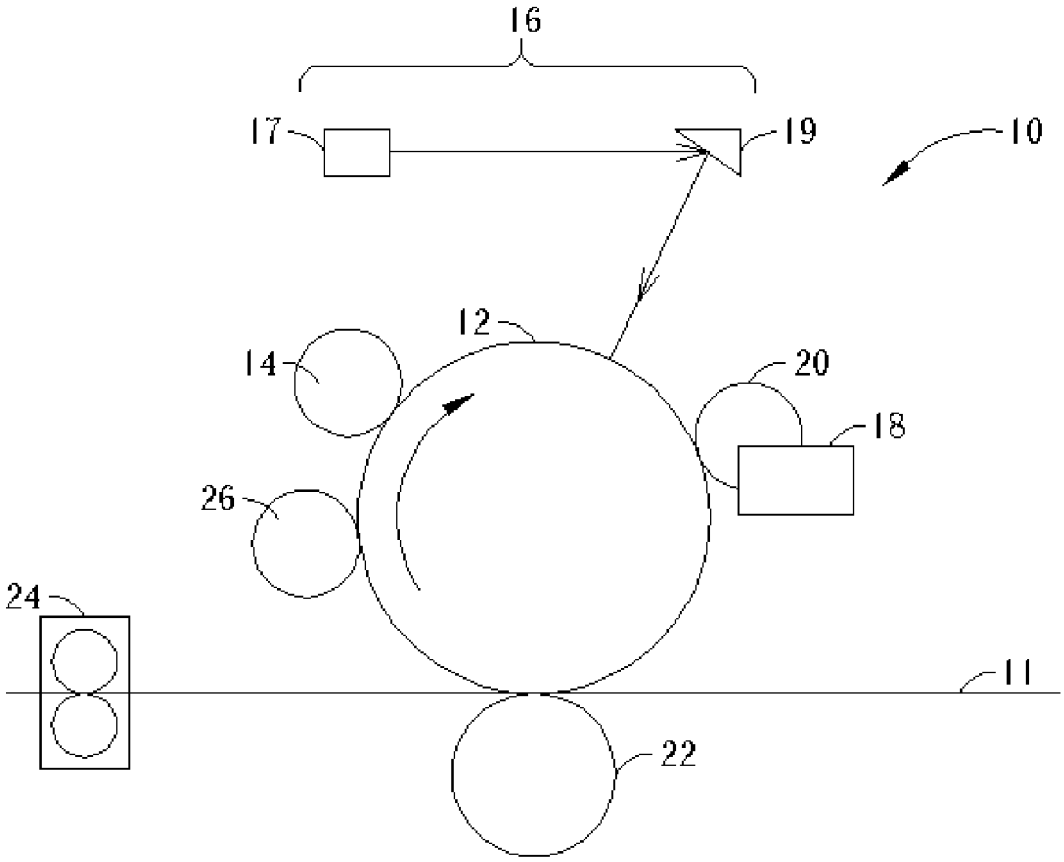
Fig. 1 Prior art
FIG. 1 is a schematic diagram of a laser printer according to the prior art.
Figure 2:
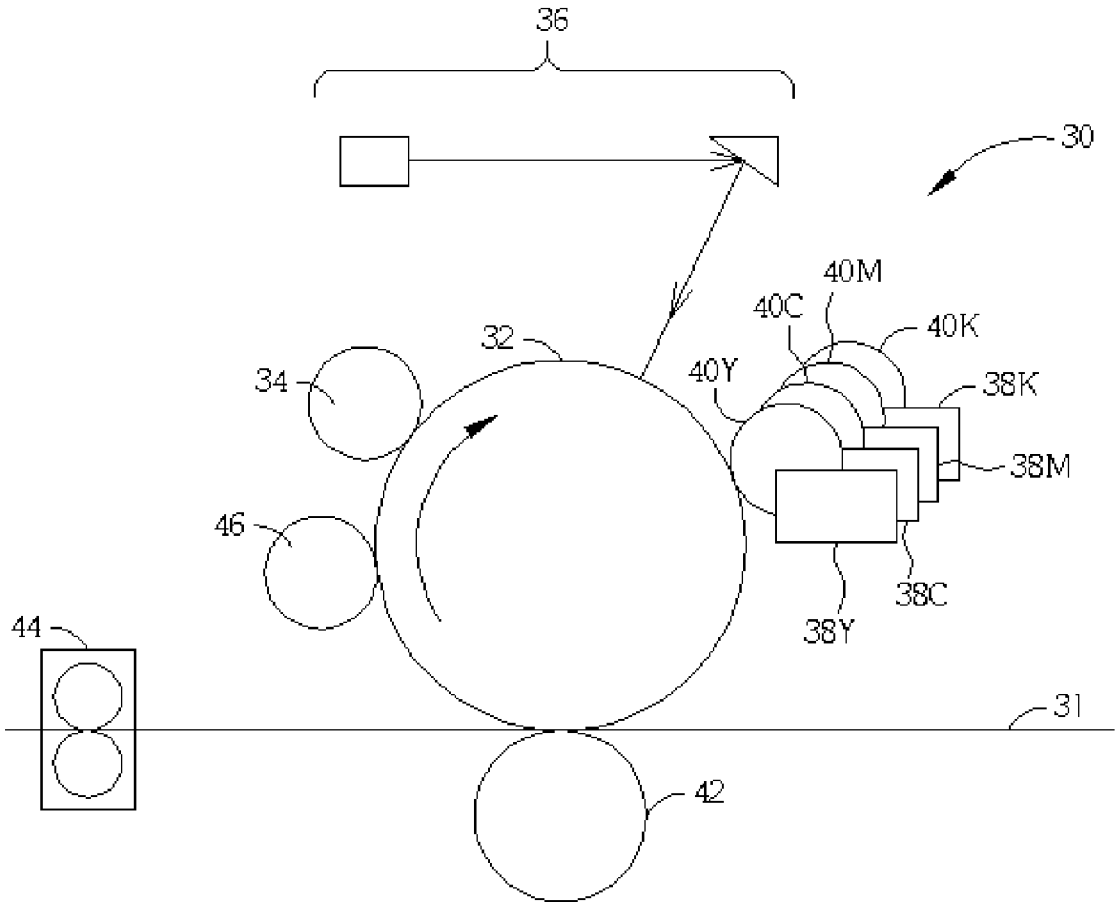
Fig. 2 Prior art
FIG. 2 is a schematic diagram of a Carousel color laser printer according to the prior art.
Figure 3:
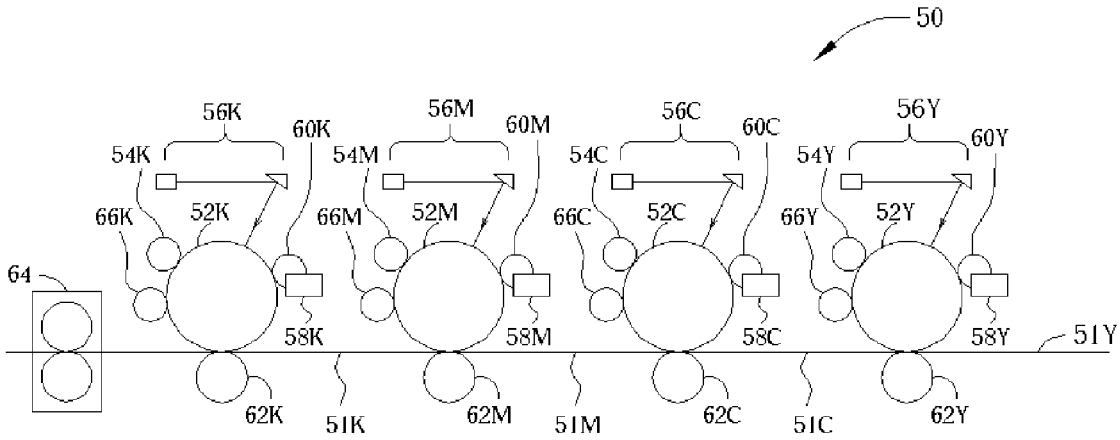
Fig. 3 Prior art
FIG. 3 is a schematic diagram of a Tandem color laser printer according to the prior art.
Figure 4:
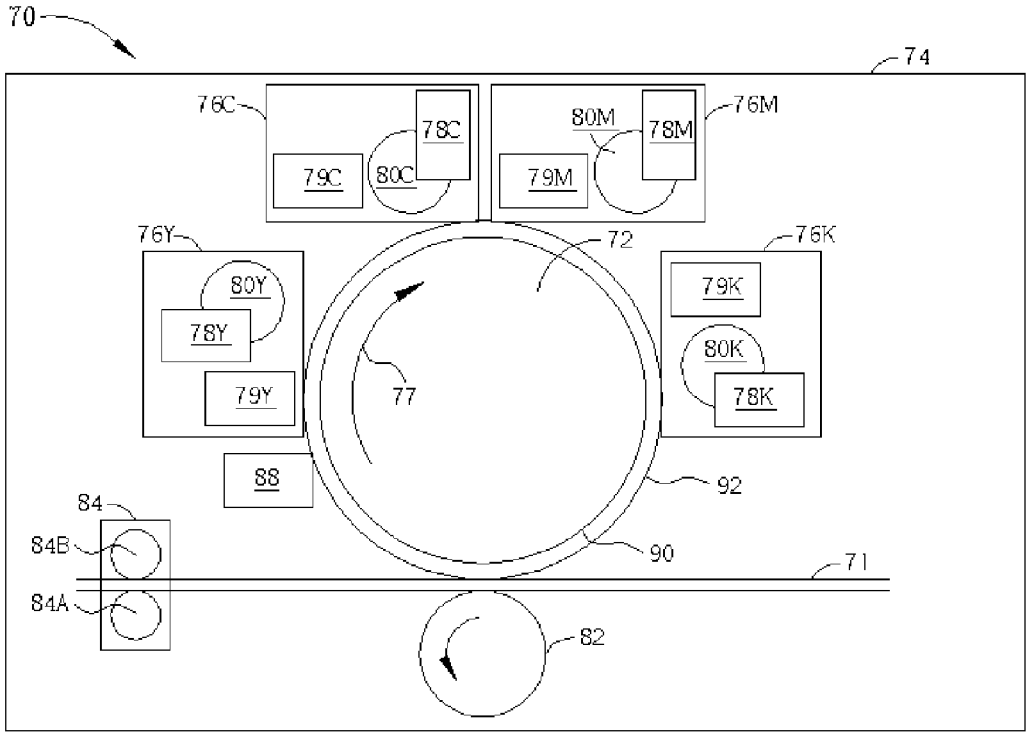
FIG. 4 is a schematic diagram of a color electrode array printer according to the present invention.

Please refer to FIG. 4, which is a schematic diagram of a color electrode array printer 70 according to the present invention. The printer comprises a housing 74, a control chip 73 (shown in FIG. 5) for controlling operations of the printer 70, an image roller 72 clockwise rotatably (indicated by arrow 77) installed inside the housing 74, four developer modules 76Y, 76C, 76M and 76K sequentially installed surrounding the image roller 72, and a transfer roller 82 counterclockwise rotatably installed adjacent to a side surface of the image roller 72.

The developer modules 76Y, 76C, 76M and 76K respectively comprise four electrode array printheads 79Y, 79C, 79M and 79K sequentially installed surrounding the image roller 72 for emitting an electron array onto the side surface of the image roller 72 by determining control signals generated by the control chip 73 and for forming an electrostatic image of a negative voltage; four toner cartridges 78Y, 78C, 78M and 78K for containing yellow, cyan, magenta and block toner respectively; and four developer rollers 80Y, 80C, 80M and 80K counterclockwise rotatably installed adjacent to the corresponding toner cartridges 78Y, 78C, 78M and 78K and to the image roller 72 for attracting toner contained in the corresponding toner cartridges 78Y, 78C, 78M and 78K. How the developer rollers 80Y, 80C, 80M and 80K attract toner contained in the toner cartridges 78Y, 78C, 78M and 78K will be described later. The electrostatic image, which is formed by the electron array emitted by the electrode array printheads 79Y, 79C, 79M and 79K, attracts toner from the developer rollers 80Y, 80C, 80M and 80K sequentially when the image roller 72 rotates to positions where the electrostatic image is adjacent to the developer rollers 80Y, 80C, 80M and 80K respectively. The toner that the electrostatic image attracts has a quantity corresponding to the number of charges that the electrostatic image contains. That is, the larger the number of charges is (corresponding to an electrostatic image of a more negative voltage), the more toner the electrostatic image can attract. On the contrary, an electrostatic image of a small number of charges (corresponding to a less negative voltage) attracts less toner.

How the developer rollers 80Y, 80C, 80M and 80K attract toner contained in the toner cartridges 78Y, 78C, 78M and 78K is described as follows. The developer roller 80Y is described here as an example. The developer roller 80Y comprises a plurality of negatively charged magnetic beads. The beads are capable of attracting the yellow toner of a positive voltage when the developer roller 80Y is rotating through the toner cartridge 78Y. Note that the negatively charged magnetic beads must have a charge level higher than that of the electrostatic image, or the electrostatic image cannot attract toner from the developer roller 80Y.

Figure 5:
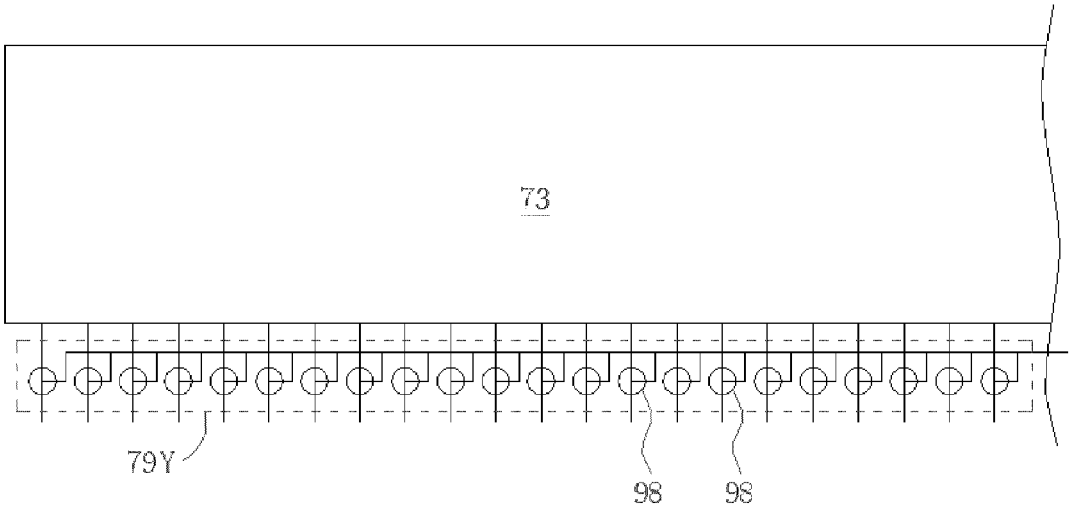
FIG. 5 is a schematic diagram of one of the electrode array printheads of the color electron array printer shown the FIG. 4 according to the present invention.

Please refer to FIG. 5, which is a schematic diagram of the electrode array printhead 79Y (the remaining electrode array printheads 79C, 79M and 79B have the same structure) of the color electron array printer 70 according to the present invention. The electrode array printhead 79Y comprises a plurality of array-disposed electrode units 98, each electrode unit 98 comprising a plurality of carbon nanotubes 96 (shown in FIG. 6) or cone-shaped electrodes 98 (shown in FIG. 8), where each cone-shaped electrode 94 (carbon nanotube 96) is controlled by the control chip 73.

Figure 6:
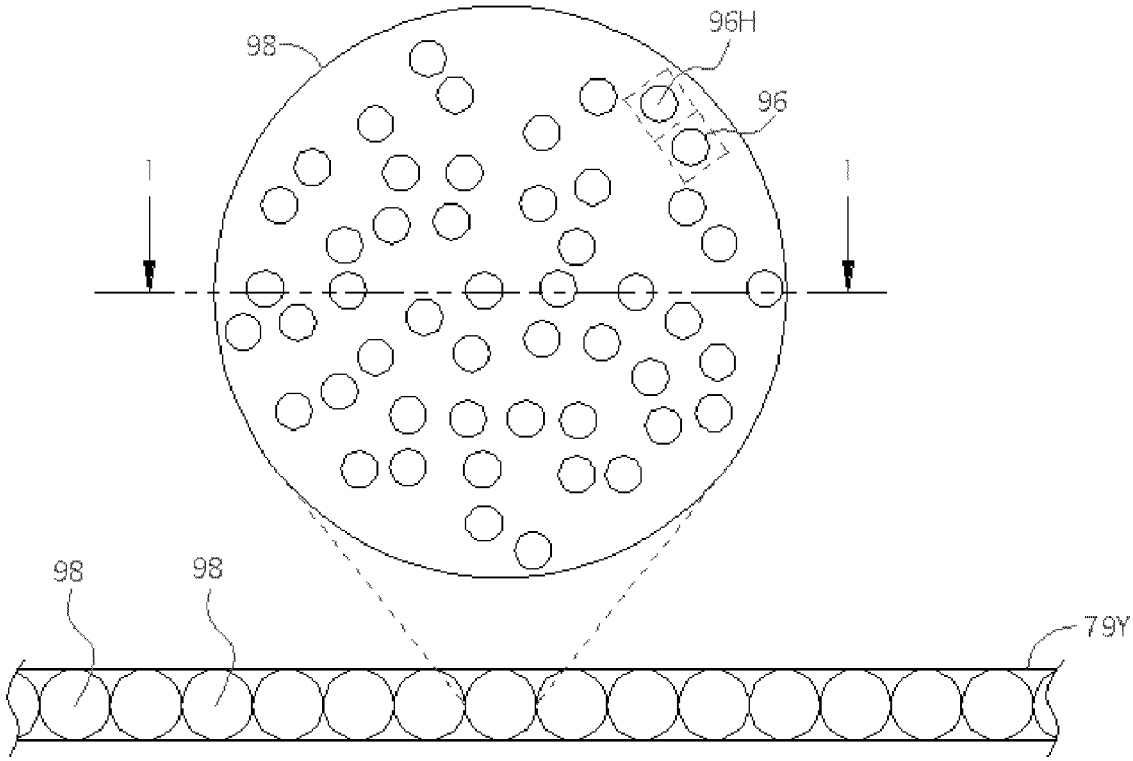
FIG. 6 is a top view diagram of an electrode unit that comprises the plurality of carbon nanotubes shown in FIG. 4 according to the present invention.
Figure 7:
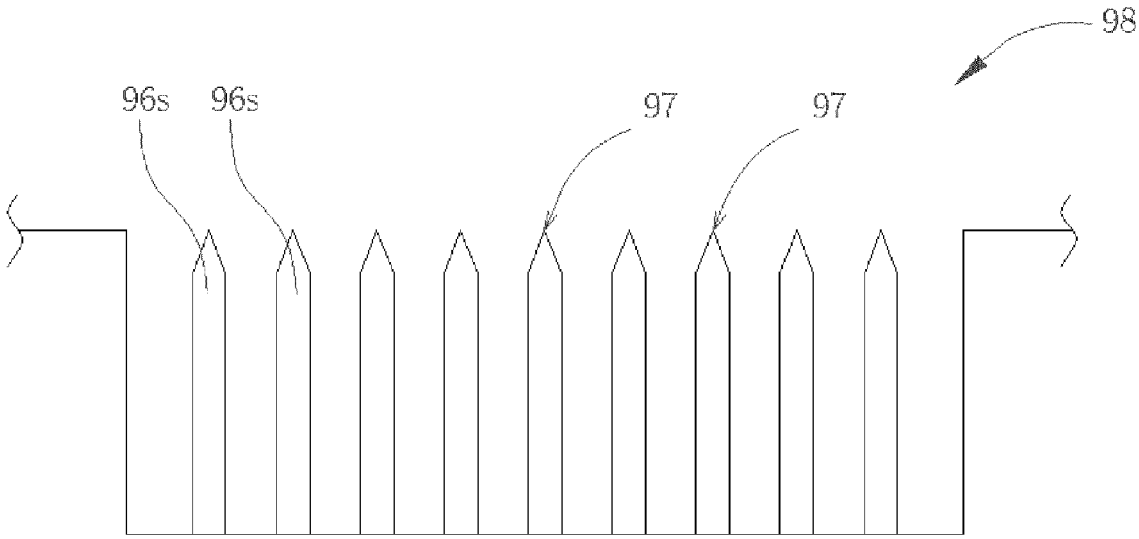
FIG. 7 is a cross-sectional diagram along a line 1—1 of the electrode unit shown in FIG. 6 according to the present invention.

Please refer to FIG. 6 and FIG. 7. FIG. 6 is a top view diagram of the electrode unit 98 that comprises the plurality of carbon nanotubes 96 according to the present invention. FIG. 7 is a cross-sectional diagram along a line 1-1 of the electrode unit 98 shown in FIG. 6 according to the present invention. The control chip 73 controls the electrode unit 98 to emit electrons onto the image roller 72 through corresponding electron emission apertures 96H (indicated by arrow 97) of the carbon nanotubes 96.

Figure 8:
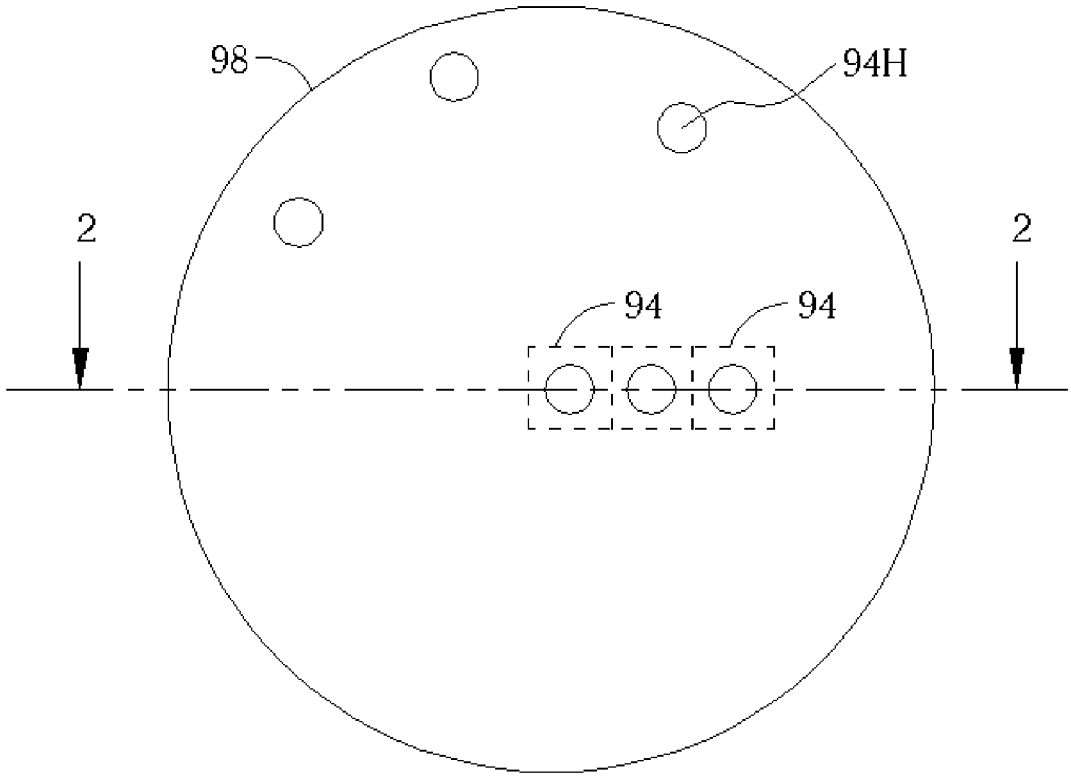
FIG. 8 is a top view diagram of an electrode unit that comprises the plurality of cone-shaped electrodes shown in FIG. 4 according to the present invention.
Figure 9:
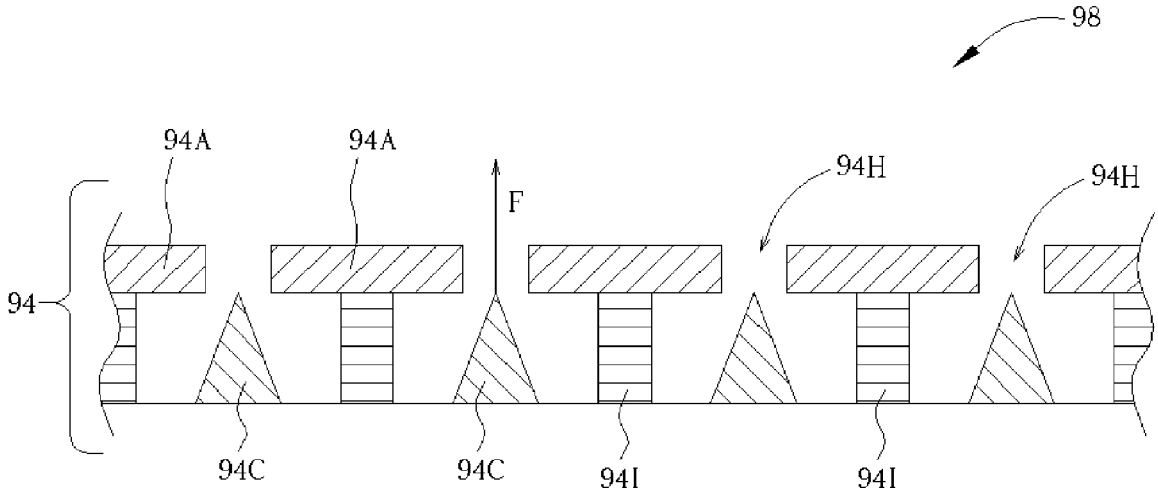
FIG. 9 is a cross-sectional diagram along a line 2—2 of the electrode unit shown in FIG. 8 according to the present invention.

Please refer to FIG. 8 and FIG. 9. FIG. 8 is a top view diagram of the electrode unit 98 that comprises the plurality of cone-shaped electrodes 94 according to the present invention. FIG. 9 is a cross-sectional diagram along a line 2—2 of the electrode unit 98 shown in FIG. 8 according to the present invention. Each of the cone-shaped electrodes 94 comprises a gated anode layer 94A, an insulating layer 941, and a cathode cone-shaped electrode 94C. The gated anode layer 94A acts with the corresponding cathode cone-shaped electrode 94C to form an electric field F. The control chip 73 controls the plurality of cathode cone-shaped electrodes 94C of the electrode unit 98 to emit electrons in a direction determined by the electric field F through the corresponding electron emission apertures 96H and onto the image roller 72.

In the above-described color electrode array printer 70, the transfer roller 82 and the developer rollers 80Y, 80C, 80M and 80K rotate along a direction corresponding to the rotation of the image roller 72. That is, if the image roller 72 is installed to rotate clockwise, the transfer roller 82 and the developer roller 80Y, 80C, 80M and 80K are to be counterclockwise rotatably installed inside the housing 74. On the contrary, if the image roller 72 is installed to rotate counterclockwise, the transfer roller 82 and the developer roller 80Y, 80C, 80M and 80K are to be sequentially installed to rotate clockwise.

The transfer roller 82 of the color electrode array printer 70 is connected to a first bias voltage, whose level is lower than that of the electrostatic image (the absolute value of the first bias voltage is larger than the absolute value of the negative voltage of the electrostatic image), so when the image roller 72 rotates to a position where the electrostatic image is adjacent to the transfer roller 82, the transfer roller 82, biased by the first bias voltage, is capable of attracting the toner on the electrostatic image onto the printing media 71 disposed between the image roller 72 and the transfer roller 82.

Figure 10:
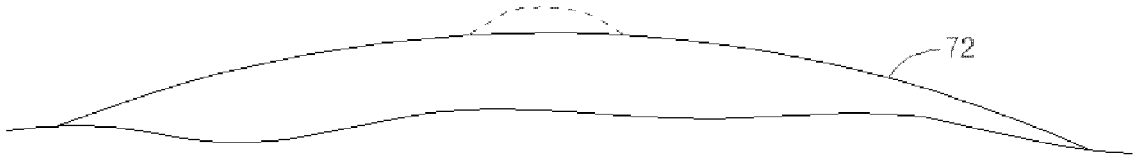
FIG. 10 is a schematic diagram of toner according to the present invention.
Figure 11:
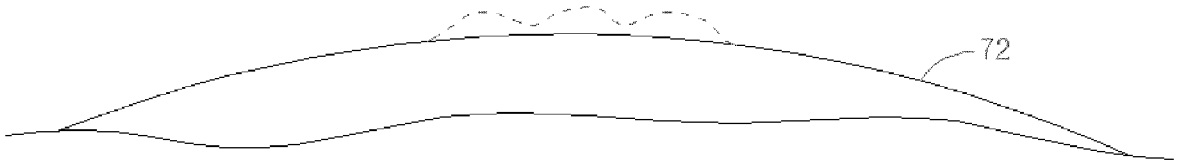
FIG. 11 is another schematic diagram of toner according to the present invention.

Please refer to FIG. 4 again. The image roller 72 of the color electrode array printer 70 comprises a conductive bias potential layer 90 connected to a second bias voltage, and a dielectric layer 92 formed on the conductive bias potential layer 90, the second bias voltage enabling the electrostatic image formed on the image roller 72 to more easily attract toner from the developer rollers 80Y, 80C, 80M and 80K. The second bias voltage is a DC voltage or a combination of a DC and an AC voltage. Please refer to FIG. 10 and FIG. 11. FIG. 10 is a schematic diagram of toner (indicated by dashed lines) attracted on the electrostatic image if the second bias voltage is a DC voltage according to the present invention. FIG. 11 is a schematic diagram of toner (indicated by dashed lines) attracted on the electrostatic image if the second bias voltage is a combination of a DC and an AC voltages according to the present invention. It can be seen from FIG. 10 and FIG. 11 that the toner on the electrostatic image is disposed flatter if the second bias voltage is the combination of a DC and an AC voltage than if the second bias voltage is merely a DC voltage. The conductive bias potential layer 90 is made of aluminum, while the dielectric layer 92 is made of a material selected from a group consisting of resin polymers, glass, and ceramic.

Please refer to FIG. 4 again. The color electrode array printer 70 further comprises a fuser 84 installed in the housing 74 and adjacent to the side surface of the image roller 72 for adhering toner disposed on the printing media 71 onto the printing media 71, and a toner blade 88 installed adjacent the side surface of the image roller 72 for wiping off toner residue on the image roller 72 after the printing media 71 has attracted toner disposed on the image roller 72. The fuser 84 comprises a backup roller 84A and a hot roller 84B, the backup roller 84A acting with the hot roller 84B to melt plastic materials of the toner disposed on the printing media 71 and adhere the melted toner onto the printing media 71.

Principles and operations of the color electrode array printer 70 are described as follows: The control chip 73 controls the electrode array printhead 79Y to emit a first electron array onto a first region of the side surface of the image roller 72 and forms a first electrostatic image onto the first region. The first electron array comprises a plurality of electrons of a variety of voltage levels, each point in the first region having a distinct voltage level accordingly. When the image roller 72 rotates to a position where the first region is adjacent to the developer roller 80Y of the developer module 76Y, the first electrostatic image on the first region attracts yellow toner from the developer roller 80Y. Since each of the points in the first region has a distinct voltage level, the electrostatic image attracts yellow toner accordingly. The first electrostatic image (of a negative voltage) does not stop attracting yellow toner (of a positive voltage) until each of the points inside the first region has a zero-level voltage (since the dielectric layer 72 of the image roller 72 does not transmit electrons, each of the points inside the first region in fact has an equivalent zero-level voltage).

The image roller 72 keeps rotating. When the image roller 72 rotates to a position where the first region is adjacent to the electrode array printhead 79C of the developer module 76C, in the same scenario, the control chip 73 controls the electrode array printhead 79C to emit a second electron array onto the first region of the image roller 72 to form a second electrostatic image onto the first region. When the image roller 72 rotates to a position where the first region is adjacent to the developer roller 80C of the developer module 76C, the second electrostatic on the first region does not stop attracting cyan toner attracted on the developer roller 80C until each of the points in the first region has an equivalent zero-level voltage.

The image keeps rotating to positions adjacent to the developer modules 76M and 76K sequentially. Operations of the developer modules 76M and 76K are the same as those of the developer modules 76Y and 76C. Further descriptions are omitted.

After passing by all of the developer modules 76Y, 76C, 76M and 76K sequentially, the first region of the first electrostatic image has attracted toner (or not, depending on a voltage level at each of the points inside the first region) of a variety of colors and volumes. When the image roller 72 rotates to a position where the first region is adjacent to the transfer roller 82, since the transfer roller 82 is connected to the first bias voltage, which is lower than voltages (a sum of voltages of first, second, third and fourth electrostatic images) at each of the points in the first region (the absolute value of the first bias voltage is larger than that of the sum), the transfer roller 82 is capable of transferring all of the toner disposed on the first region of the image roller 72 onto the printing media 71. The printing media 71 then passes through the fuser 84, the fuser 84 melting and adhering toner disposed on the printing media 71 with the heat generated by the hot roller 84.

Eventually, when the image roller 72 rotates to a position where the first region is adjacent to the toner blade 88, the toner blade 88 wipes off toner residue on the image roller 72. When the image roller 72 rotates to a position where the first region is adjacent to the electrode array printhead 79Y of the developer module 76Y again, the color electrode array printer 70 can print to another printing media by repeating above-mentioned procedures.

In contrast to the prior art, the electrode array printheads 79Y, 79C, 79M and 79K of the color electrode array printer 70 substitute for the charged rollers 14, 34 and 54 and the laser beam units 16, 36 and 56 of the laser printers 10, 30 and 50. The present invention provides a color electrode array printer that does not require operations of charge disposition and discharging. The color electrode array printer 70 is cheaper and more compact than the laser printers 10, 30 or 50. In addition, the color electrode array printer 70 has higher efficiency than the Carousel color laser printer 30.

Following the detailed description of the present invention above, those skilled in the art will readily observe that numerous modifications and alterations of the device may be made while retaining the teachings of the invention. Accordingly, the above disclosure should be construed as limited only by the metes and bounds of the appended claims.

What is claimed is:

1. An electrode array printer comprising:

a housing;

an image roller rotatably installed inside the housing;

a plurality of developer modules installed surrounding the image roller, each of the developer modules comprising:

an electrode array printhead installed neighbor to a side surface of the image roller for emitting an electron array of a predetermined level onto the side surface and forming an electrostatic image on the side surface;

a toner cartridge installed inside the housing for containing toner; and a developer roller rotatably installed neighbor to the toner cartridge, the developer roller capable of attracting the toner contained in the toner cartridge, and the electrostatic image capable of attracting toner attracted by the developer roller when the developer roller rolls to a position where the developer roller is neighbor to the electrostatic image; and a transfer roller rotatably installed neighbor to the side surface of the image roller and electrically connected to a first bias voltage, the first bias voltage enabling a printing media disposed between the image roller and the transfer roller to attract toner attracted by the electrostatic image.

2. The electrode array printer of claim 1, wherein the image roller comprises:

a conductive bias potential layer electrically connected to a second bias voltage; and a dielectric layer formed on the conductive bias potential layer;

wherein the second bias voltage enables the electrostatic image formed on the image roller to attract toner in the toner cartridge.

3. The electrode array printer of claim 2, wherein the conductive bias potential layer is made of aluminum.

4. The electrode array printer of claim 2, wherein the conductive bias potential layer is made of resin polymers.

5. The electrode array printer of claim 2, wherein the dielectric layer is made of glass.

6. The electrode array printer of claim 2, wherein the dielectric layer is made of ceramic.

7. The electrode array printer of claim 2, wherein the second bias voltage is a DC voltage.

8. The electrode array printer of claim 2, wherein the second bias voltage is a combination of a DC voltage and an AC voltage.

9. The electrode array printer of claim 1, wherein the electrostatic image formed on the image roller attracts toner of a quantity corresponding to the first bias voltage.

10. The electrode array printer of claim 1 comprising four developer modules.

11. The electrode array printer of claim 10, wherein the four developer modules have four toner cartridges containing yellow, cyan, magenta and black toner respectively.

12. The electrode array printer of claim 1, wherein the electrode array printhead comprises a plurality of carbon nanotubes.

13. The electrode array printer of claim 1, wherein the electrode array printhead comprises a plurality of cone-shaped electrodes.

14. The electrode array printer of claim 13, wherein the cone-shaped electrodes are gated electrodes.

15. The electrode array printer of claim 1 further comprising a toner blade installed inside the housing for wiping off toner residue on the image roller after the printing media has attracted toner disposed on the image roller.

16. The electrode array printer of claim 1 further comprising a fuser installed inside the housing for adhering toner disposed on the printing media onto the printing media.

17. The electrode array printer of claim 16, wherein the fuser comprises a pair of fuser rollers for melting toner disposed on the printing media when the printing media is passing through the fuser rollers.

* * * * *